US006230884B1

(12) United States Patent
Coory

(10) Patent No.: US 6,230,884 B1
(45) Date of Patent: May 15, 2001

(54) DISCHARGE CAP WITH RELEASABLE TABLET BASKET

(75) Inventor: Fredrick Michael Coory, 1 Dymock Place, Christchurch (NZ)

(73) Assignee: Fredrick Michael Coory, Christchurch (NZ)

( * ) Notice: Subject to any disclaimer, the term of this patent is extended or adjusted under 35 U.S.C. 154(b) by 0 days.

(21) Appl. No.: 09/380,858

(22) PCT Filed: Mar. 12, 1998

(86) PCT No.: PCT/NZ98/00034

§ 371 Date: Sep. 9, 1999

§ 102(e) Date: Sep. 9, 1999

(87) PCT Pub. No.: WO98/40289

PCT Pub. Date: Sep. 17, 1998

(30) Foreign Application Priority Data

Mar. 12, 1997 (NZ) ..... 314396

(51) Int. Cl.[7] ..... B65D 25/08

(52) U.S. Cl. ..... 206/222; 222/136; 215/DIG. 8

(58) Field of Search ..... 206/222, 219; 222/135, 136, 82, 129, 129.1; 215/DIG. 8

(56) References Cited

U.S. PATENT DOCUMENTS

| | | | | |
|---|---|---|---|---|
| 2,642,870 | * | 6/1953 | Smith | 206/222 |
| 2,731,965 | * | 1/1956 | Haralson, Jr. | 206/222 |
| 3,156,369 | * | 11/1964 | Bowes et al. | 206/222 |
| 3,347,410 | | 10/1967 | Schwartzman . | |
| 3,521,745 | * | 7/1970 | Schwarzman | 206/222 |
| 3,968,872 | * | 7/1976 | Cavazza | 222/83 |
| 4,244,467 | * | 1/1981 | Cavazza | 206/222 |
| 4,741,437 | * | 5/1988 | Gorski et al. | 206/222 |
| 4,941,751 | * | 7/1990 | Muhlbauer | 206/222 |
| 5,782,345 | * | 7/1998 | Gausch et al. | 206/222 |
| 5,971,140 | * | 10/1999 | Frutin | 206/222 |

FOREIGN PATENT DOCUMENTS

| | | |
|---|---|---|
| 40755/95 | 6/1997 | (AU) . |
| 8-91418 | 4/1996 | (JP) . |
| WO 93/14990 | 8/1993 | (WO) . |
| WO 98/00348 | 1/1998 | (WO) . |

* cited by examiner

*Primary Examiner*—Paul T. Sewell
*Assistant Examiner*—Shian Luong
(74) *Attorney, Agent, or Firm*—Greer, Burns & Crain, Ltd.

(57) ABSTRACT

A cap for a container where a drink, made of two components, can be stored or carried with the components stored separately. The components are mixed prior to the consumption of the drink. The cap includes a collar secured to the container and a top which is in two parts. The top is moveable between an open and a closed position. When the top is initially in the open position, a basket between the top and the liquid initially holds the material, which can be a powder or tablet. The top is initially closed to release the seal between the liquid and the material, the drink is shaken, and the top reopened for a passageway from the liquid to the exterior of the cap. A cover is releasably secured over the cap.

6 Claims, 4 Drawing Sheets

DISCHARGE CAP WITH RELEASABLE TABLET BASKET

TECHNICAL FIELD

The present invention relates to a cap for a container, in which the cap includes means for releasing material contained within the cap into the container.

BACKGROUND ART

Different styles of caps or lids for containers (for liquids) are prolific. They are known in a variety of forms, which can include, for example: a tamper-evident ring; the ability to be re-sealable; a screw-thread; or a combination of these. Such caps also include those that can be drunk through and resealed ("sipper tops"), either with or without a screw thread, so that the container is re-usable.

Drinks and drink containers where two components making the drink are best mixed immediately before drinking are available separately. However for some types of drink, where the concentrate is in tablet or powder form, the availability of drinks with all elements for the drink in the one container are rare and hard to find commercially.

An object of the present invention is the provision of a cap which, when combined with an appropriate container, permits two elements of a drink to be separately contained within the one container and mixed immediately before the user desires the drink. A further object of the invention is the provision of such a cap and container so as to offer an economic alternative to presently available containers.

For the purposes of this specification, the term "cap" is used to describe any lid or cap or closure for a container or bottle with a top opening. Also, the term "container" is used to cover any vessel with a top opening which is capable of carrying or retaining a liquid, regardless of the material of which it is made.

SUMMARY OF THE INVENTION

The present invention provides a cap for a container with a top opening and capable of containing a drinkable liquid, said cap including:

a collar with means for securing the cap to the container about the top opening, said collar being formed with a cylindrical collar passage therethrough;

a neck portion including a top portion, a bottom portion, and a centrally located seal-breaking means, wherein the neck portion has at least one neck a passage therethrough, and said top portion is moveable relative to the collar, said top portion being moveable between an open position in which position the top portion is spatially separated from the collar and a closed position in which position the top portion is sealed against said bottom portion, and in which closed position said neck portion provides a seal for retaining liquid within the container; and a basket capable of containing therein a material which is capable of dissolution in the liquid in the container;

releasable means for maintaining the top portion in the open position; and a cover which is releasably securable to the collar about the cap; wherein when initially said top portion is in said open position the liquid is sealed within said container by the basket, and when said top portion is initially moved to the closed position said seal provided by the basket is broken by the interaction of said seal-breaking means and the basket; and wherein thereafter, when the top portion is moved to the open position, a passage for fluid from the container is provided, through the collar passage and the neck passage and when the top portion is in the closed position, a seal for retaining liquid within the container is thereby provided.

Preferably said cap is capable of reuse with a new basket, so that the cap and container can be used for more than one drink in which the liquid and the powder are kept separate until required as a finished drink.

Preferably, the neck portion includes a seal-breaking means that is in the form of a prong or pointed end, which is integrally formed with the top portion. The top portion forms part of a sipper top (being re-usable, re-sealable) of known type, and the basket is formed from a piece of foil. Said foil includes a foil wrapped tablet. The seal-breaking means pierces the foil, thus releasing the tablet for dissolution within the liquid in the container.

Preferably, the cover and the collar have therebetween a tamper-evident ring or other known means of determining evidence of tampering. The cover is either an interference fit with the collar or is screw-threaded onto the collar, to permit the cover to be repeatedly put on and taken off the cap.

BRIEF DESCRIPTION OF THE DRAWINGS

By way of example only, a preferred embodiment of the present invention is described in detail with reference to the accompanying drawings, in which.

BEST MODE FOR CARRYING OUT THE INVENTION

Figure 1:
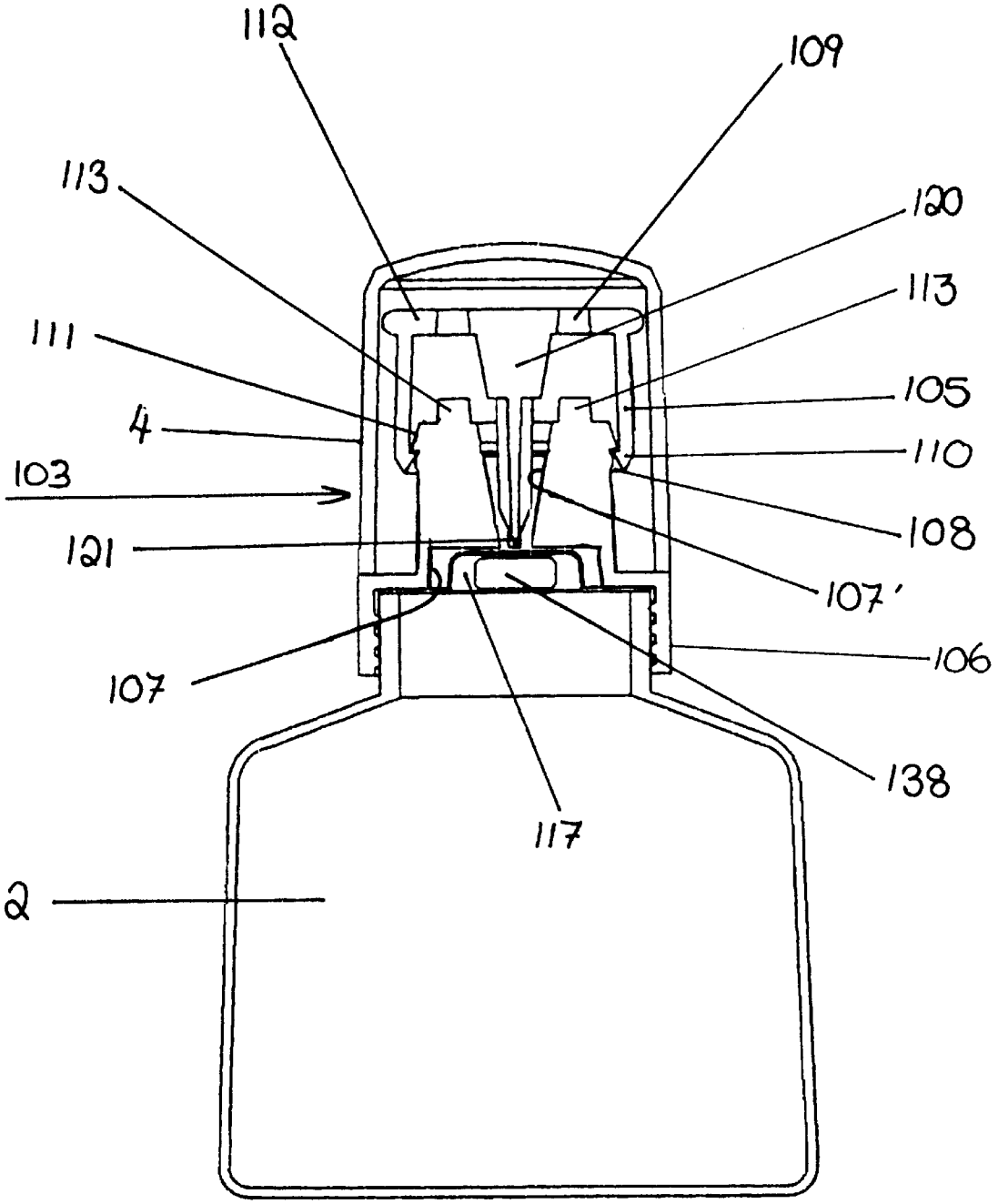
FIG. 1 is a side section view of a preferred embodiment of the cap and container, with the cap in the initial position, in accordance with the present invention.

Referring to the drawings, a container with a cap 103 is shown. The cap 103 includes a screw-thread that is compatible with the screw-thread on the outside of the top of the container 2. Alternatively, the cap 103 may be a snap fit to the top of the container 2, in known manner. The fit can be either a releasable snap fit or not, as is desired.

The cap 103 can be fitted onto a container 2 with either a screw thread or a snap fit and be can re-usable, or not, as is desired.

The cap 103 includes a cover 4, a neck portion 105 and a collar 106. The collar 106 may extend to include the screw-thread or snap fit as described above and may also be formed integrally therewith, if so desired. The neck portion 105 includes a lower, circular-shaped edge 110 which is slidably engaged with the periphery of the upper portion of the collar 106.

At the top end of the collar 106 is formed an arcuate projection 108. The projection 108 is peripheral to the collar 106. The projection 108 aids in keeping the neck portion 105 in the open position by retaining the lower shaped edge 110 thereabove, until external force in the direction of arrow C (FIG. 3) forces the neck portion 105 past the projection 108. Immediately above the projection 108 is a hook 111 formed integrally with the collar 106, which is peripheral to the top of the collar 106. The hook 111 interacts with the shaped edge 110 to prevent the top coming off the collar unintentionally when the neck portion 105 is being moved between the open and the closed positions (described below).

The neck portion 105 includes a top 112 with at least one hole 109 therethrough. The number of holes 109 may be increased up to four, as is desired. A downwardly facing prong 120 is secured to the underside of the top 112, or formed integrally therewith, as is desired. The prong 120 has a shaped tip 121 which may be sharpened for piercing foil, if so desired. As shown in FIG. 6 the prong 120 may have a cross-section in the shape of a cross. Alternatively, if so desired, the prong 120 may have another cross-section, for example circular.

The internal sides 107 of the collar 106 may be circular in cross-section, as in the first preferred embodiment. Alternatively, if so desired, the shape may include complementary internal sides 107' to the configuration of the prong 120 to assist in retaining the prong 120 in the one central position relative to the sides of the cap 103. The sides (107 or 107') and the prong 120 form a shaped collar passage through the collar 106.

The top of the collar 106 includes at least one shaped projection 113. The projections 113 are of a number and shaped in a manner complementary to the holes 109 in the neck portion 105. Thus when the neck portion 105 is in the closed position the projections 113 enter the holes 109 and form a liquid seal between the exterior of the container 2 and the exterior of the container 2.

An liquid seal between the interior of the container 2 and the cap 103 is formed by a basket 117. The basket 117 comprises a patch of foil which has a diameter such that the foil extends between the top of the container 2 and the collar 106, forming a seal therebetween. The basket 117 encases the tablet 138 between two layers of foil, which is sealed into the foil casing by known means.

When the neck portion 105 is in the initial open position, the lowest part of the tip 121 is positioned above the top of the basket 117 (FIG. 1).

Figure 3:
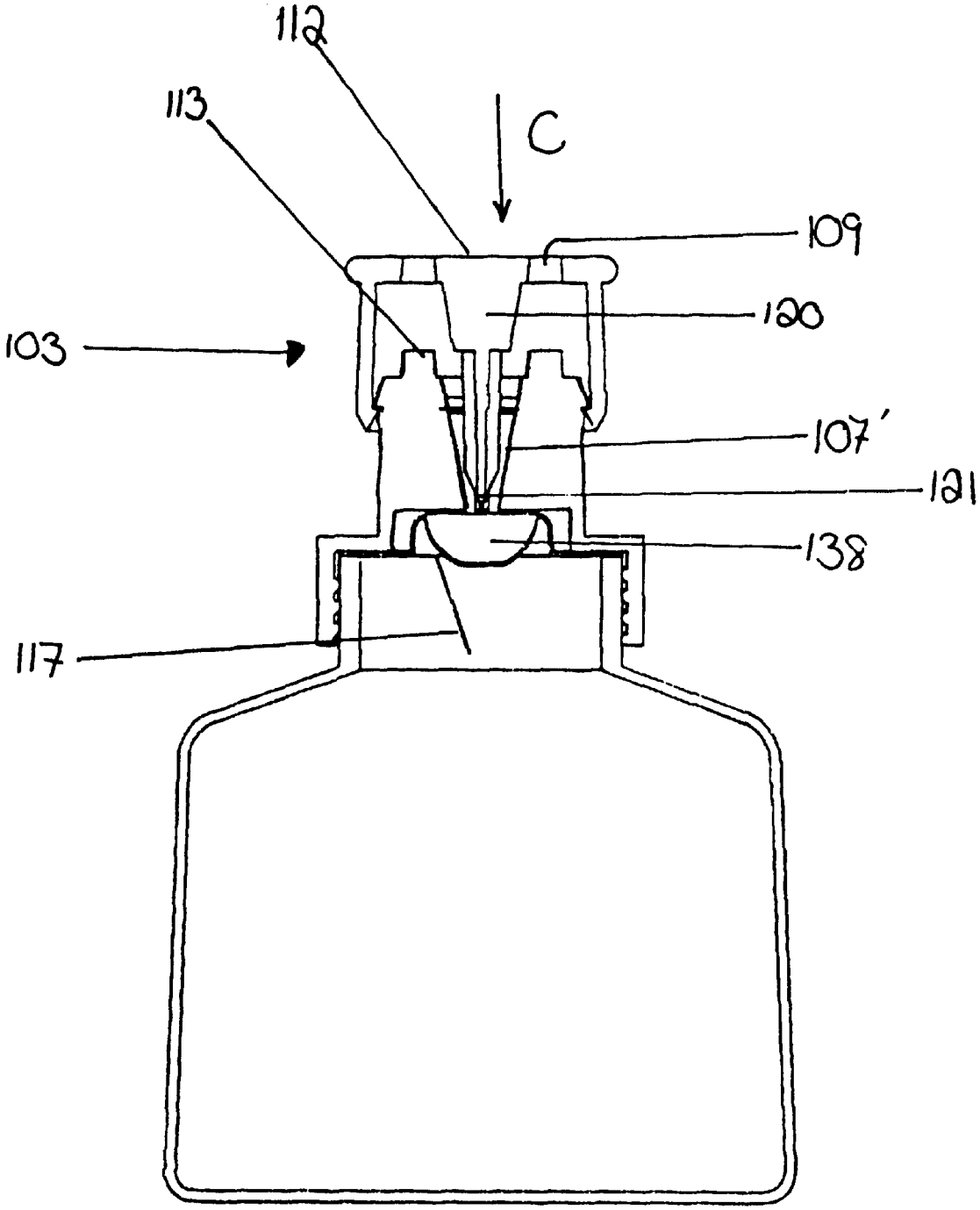
FIG. 3 is a side section view of the cap and container of the preferred embodiment between the initial open position and a closed position.
Figure 4:
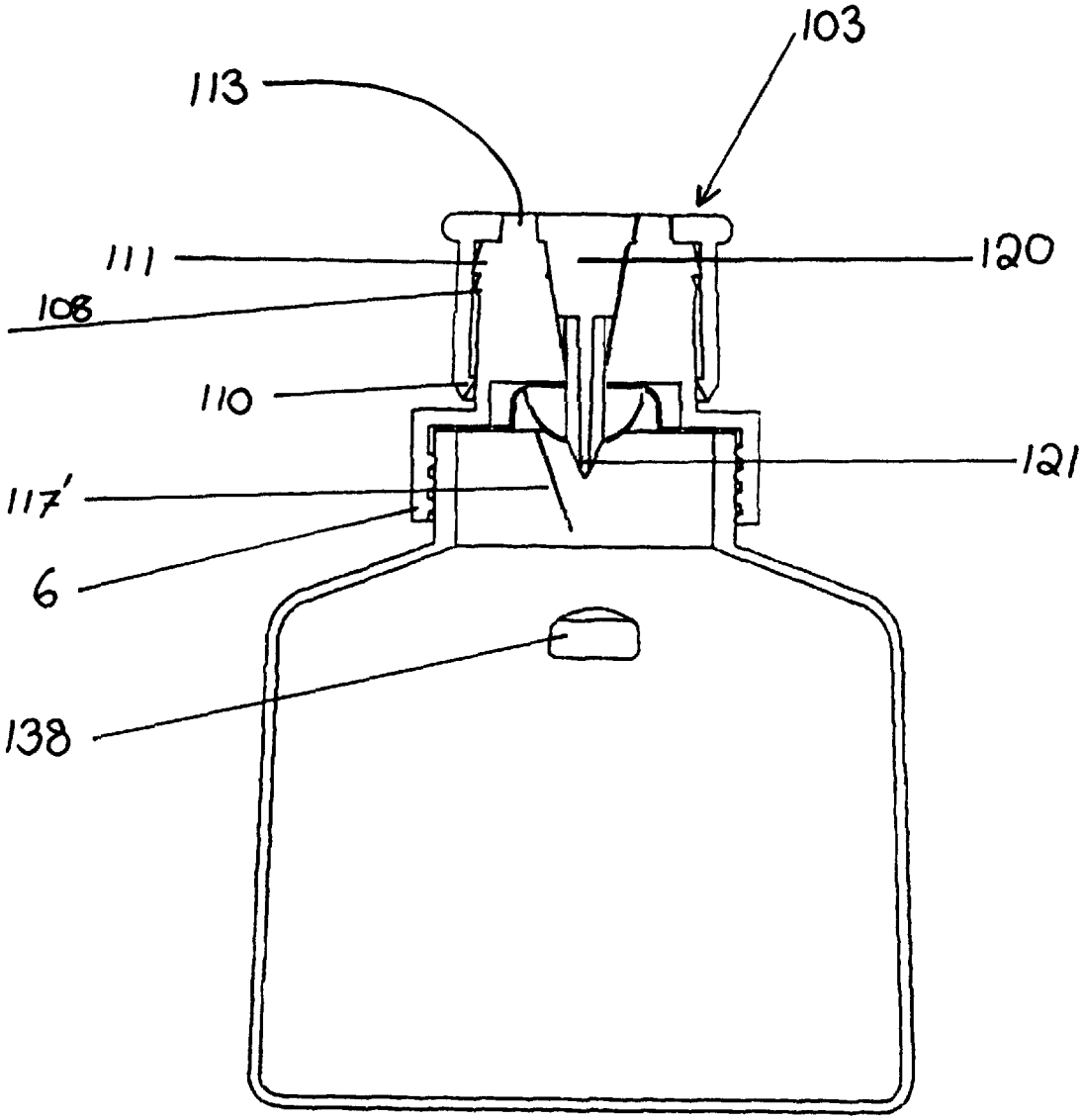
FIG. 4 is a second side section view of the preferred embodiment between the initial open position and the closed position.

The above described embodiment works as follows: the cover 4 is removed and the neck portion 105 pushed downward (arrow C, FIG. 3). This forces the tip 121 against the foil of the basket 117. The lower portion of this foil basket 117' (FIGS. 3 and 4) gives way, allowing the tablet 138 to fall into the container 2. At the same time, this downward movement forces the shaped edge 110 over the projection 108. The motion of the neck portion 105 is stopped when the projections 113 sit in the holes 109, forming a liquid seal between the interior and the exterior of the cap 103. The container 2 can be shaken or agitated so that the solid in the tablet 138 dissolves in the liquid in the container 2.

Figure 2:
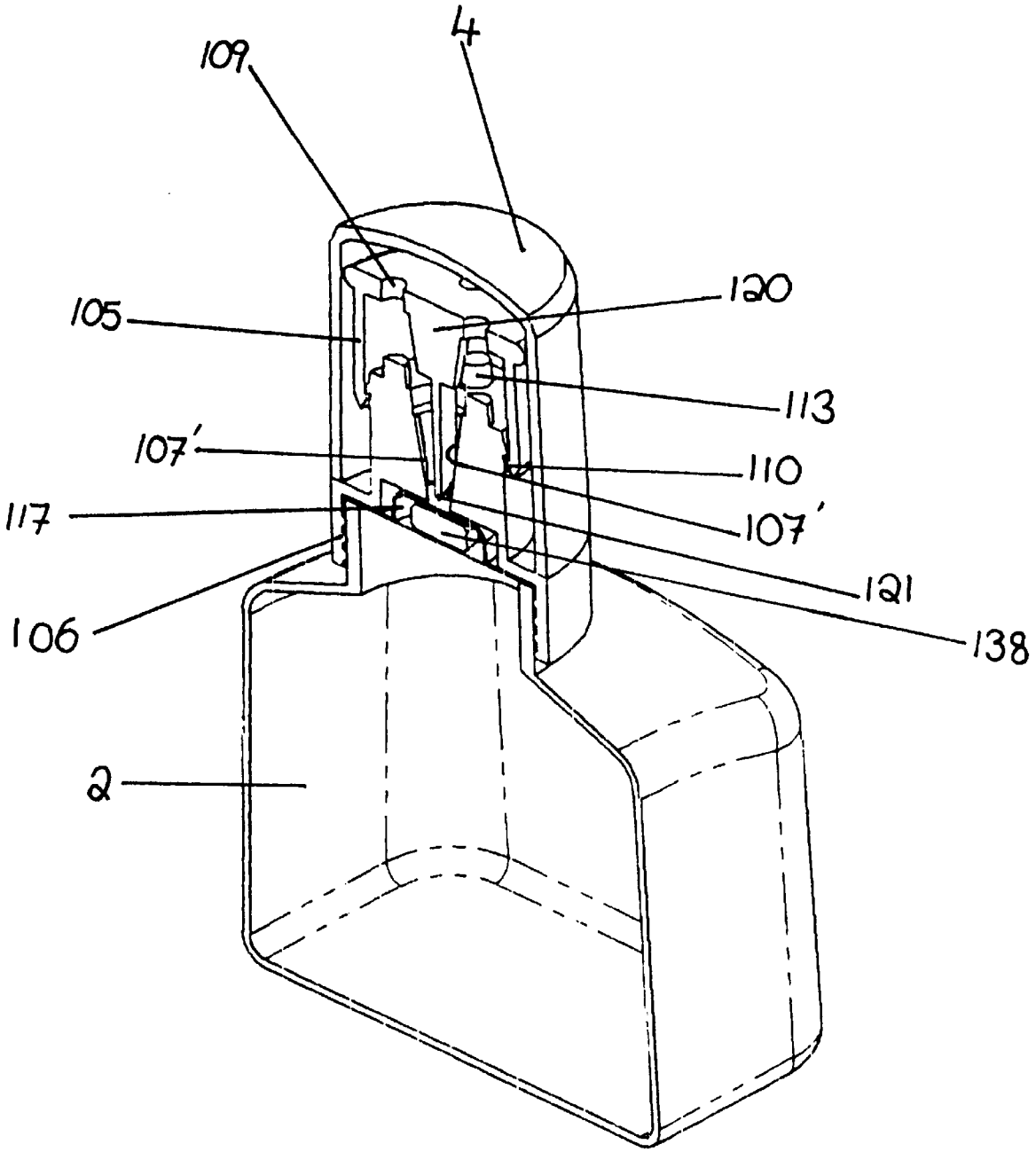
FIG. 2 is a perspective section view of the embodiment as shown in FIG. 1.

When the drink is to be drunk, the neck portion 105 is lifted upward (to the position shown in FIG. 2). With the basket 117 seal broken there is a liquid passage from the container 2, through the basket 117, the collar 106 and the neck portion 105 to the exterior. If the container 2 is to be resealed, the neck portion 105 is pushed downward again, so that the projections 113 sit in the holes 109, forming the liquid seal again. Thus the container 2 can be safely carried after partial consumption of the liquid within the container 2.

The container 2 and cap 103 can be re-used, if so desired. The cap 103 can be removed from the container 2 and a fresh basket 117 with tablet 138 passed on the top of the container 2. The cap 103 can be replaced on the container 2 and the cover 4 replaced over the cap 103. Thus the container 2 and cap 103 can be carried and reused, if so desired.

The above cap 103 and container 2 have been described with reference to a cap 103 that may be re-used. However it will be appreciated that the container 2 and cap 103 can be manufactured and sold in a ready to use format, permitting a once-only use for one drink. Also, the cap 103 and container 2 have been described with reference to the use of a snap fit on the cap 103. If so desired, the cap 103 and container 2 may be screw-threaded, so that both may be recycled.

As can be seen, the material to be added to the drink need not be in tablet form, but may be a powder either loose or slightly compressed. Also, the resultant drink may be one that is a suspension, not a solution, as is desired. The tablet may include an effervescing agent, as is desired.

The above described container 2 and cap 103 have been described with reference to a collar 106, neck 105 (etc) that are all circular in cross-section. However it will be appreciated that the invention need not be limited to such a cross-sectional shape, and that the two cross-sections need not be the same, without departing from the scope of the invention.

The cap 103 with cover 104 can be formed of any plastics material. The component parts may be machined and milled, cast, or injection moulded, as is desired.

What is claimed is:

1. A cap for a container with a top opening and capable of containing a drinkable liquid, said cap including:

a collar with means for securing the cap to the container about the top opening, said collar being formed with a cylindrical collar passage therethrough;

a neck portion including a top portion, a bottom portion, and a centrally located seal-breaking means, said neck portion having at least one neck passage therethrough, and said top portion is moveable relative to said collar, said top portion being moveable between an open position in which said top portion is spatially separated from said collar, and a closed position in which said top portion is sealed against said collar, and while in said closed position, said neck portion provides a seal for retaining liquid within the container; and a basket capable of containing therein a material which is capable of dissolution in the liquid in the container;

releasable means for maintaining said top portion in said open position;

a cover which is releasably securable to said collar about said cap; wherein said top portion being configured so that when in said open position, the liquid is sealed within said container by said basket, and when said top portion is initially moved to said closed position, said seal provided by said basket is broken by the interaction of said seal-breaking means and said basket, and said neck passage is blocked by engagement between portions of said collar and said neck; and thereafter, when said top portion is moved to said open position, a passageway for fluid from the container is provided through said collar passage and said neck passage, and when the top portion is in the closed position, a seal for retaining liquid within the container is thereby provided.

2. A cap for a container as claimed in claim 1 wherein said cap is capable of re-use, the collar having releasably securable means for securing the cap to the container.

3. A cap for a container as claimed in claim 1 wherein the top portion of the neck includes a section that narrows to a narrow opening with a diameter less than the diameter of the top of the container, and the sealing means includes two flat surfaces, one of the top of the collar and one on the underside of a flange on the neck portion and wherein the fit between the neck portion an the collar is a push fit.

4. A cap for a container as claimed in claim 1 wherein the neck portion includes a seal-breaking means that is in the form of a prong or pointed end, which is integrally formed with the top portion.

5. A cap for a container as claimed in claim 1 wherein the cap is capable of re-use with a new basket.

6. A cap for a container as claimed in claim 1 wherein the basket is formed from a piece of foil and the material is in tablet form encased within the foil.

* * * * *